United States Patent [19]

Johnson

[11] Patent Number: 4,631,938

[45] Date of Patent: Dec. 30, 1986

[54] ACCESSORY LOCKING DEVICE FOR A DOORKNOB HAVING A KEYHOLE THEREIN

[76] Inventor: Gordon E. Johnson, P.O. Box 778, Cando, N. Dak. 58324

[21] Appl. No.: 745,215

[22] Filed: Jun. 17, 1985

[51] Int. Cl.[4] ..... E05B 13/00

[52] U.S. Cl. ..... 70/209; 70/158; 70/163; 70/427

[58] Field of Search ..... 70/209, 218, 424, 427–428, 70/158–173, 181, 14, 50, 178, 188, 219–221; 292/307 B

[56] References Cited

U.S. PATENT DOCUMENTS

| | | | |
|---|---|---|---|
| 788,435 | 4/1905 | Simpson | 292/307 B |
| 928,820 | 7/1909 | Tabor | 70/14 |
| 1,814,412 | 7/1931 | Rutten | 292/307 B |
| 1,829,444 | 10/1931 | Goebel et al. | 70/209 |
| 2,169,438 | 8/1939 | Sherman | 70/163 |
| 3,245,240 | 4/1966 | DeForrest | 70/209 |
| 3,636,742 | 1/1972 | Raney | 70/424 |
| 4,296,615 | 10/1981 | Zoor | 70/181 |
| 4,300,373 | 11/1981 | Camos et al. | 70/164 |
| 4,561,273 | 12/1985 | Robinson | 70/209 |
| 4,570,470 | 2/1986 | Gray, Sr. | 70/424 |

*Primary Examiner*—Gary L. Smith
*Assistant Examiner*—Suzanne L. Dino
*Attorney, Agent, or Firm*—Peterson, Wicks, Nemer & Kamrath

[57] ABSTRACT

The accessory locking device including hingedly connected shells having confrontable flanges that have convexly curved outer surface portions, each flange having a notch therein. A keeper tube has a slot so that the keeper tube is longitudinally slidable over the convexly curved portions of said flanges. Secured to the keeper tube is an auxiliary cylindrical lock having a projectable and retractable bolt, said bolt being projectable through a hole in the keeper tube so as to provide obstructive interference with the notches in said flanges. In this way, the keeper tube cannot be slidably withdrawn from the flanges until the bolt is fully retracted from the notches.

14 Claims, 6 Drawing Figures

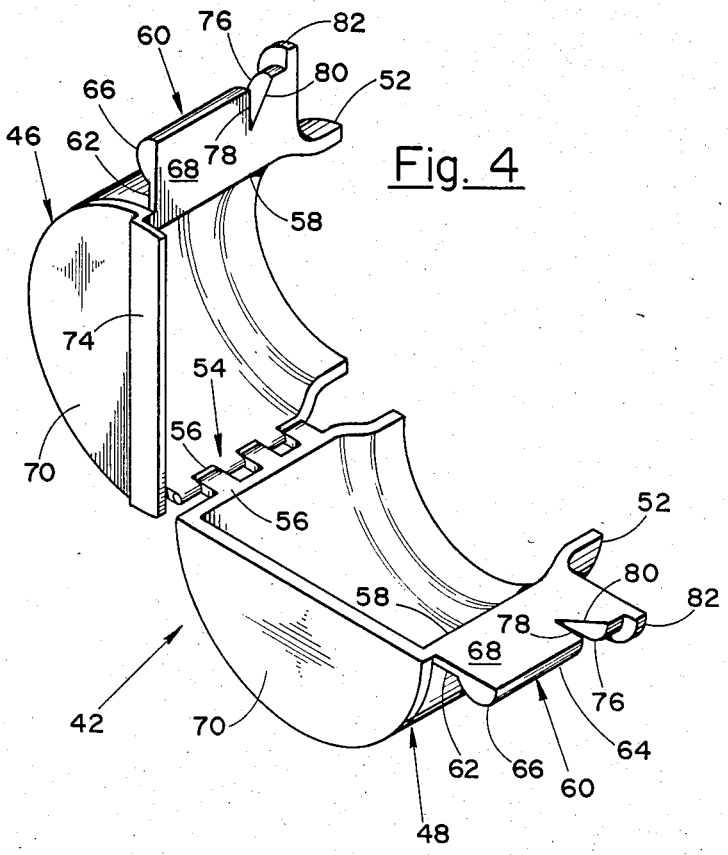
Fig. 4
Fig. 5
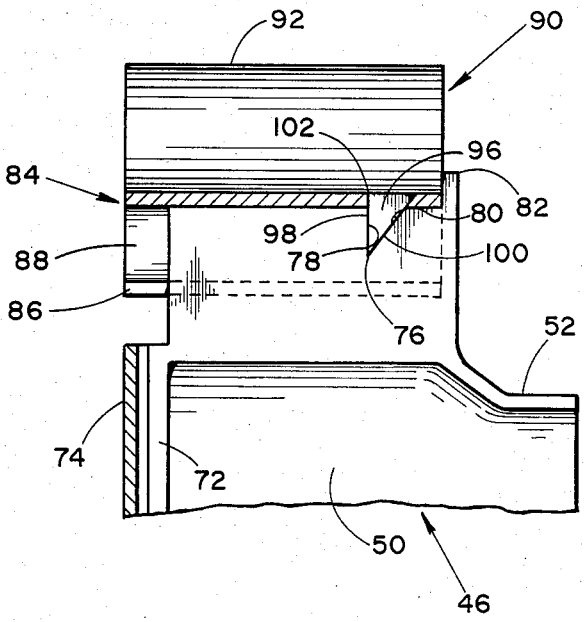
Fig. 6
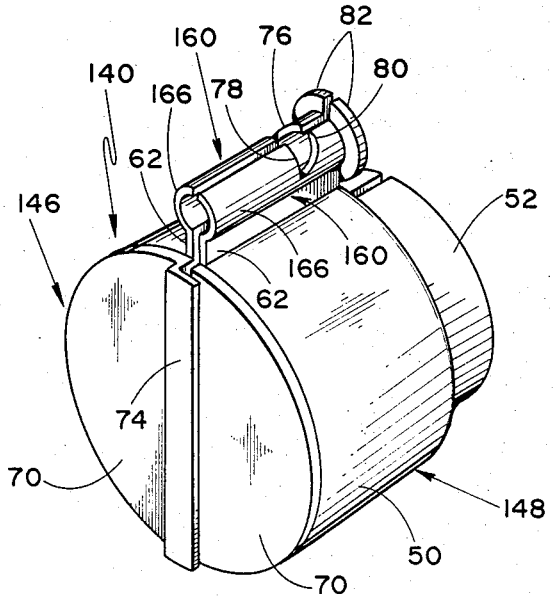

ACCESSORY LOCKING DEVICE FOR A DOORKNOB HAVING A KEYHOLE THEREIN

BACKGROUND OF THE INVENTION

1. Field of the Invention

This invention relates generally to door locks, and pertains more particularly to accessory devices for preventing access to the keyhole of a doorknob.

2. Description of the Prior Art

So-called key-in-knob locks are commonly employed in the doors to rooms of hotels and motels. While various arrangements are provided for the protection of the occupant when in his or her room, such as dead bolt locks and chains, a problem exists with respect to unauthorized entry from the outside when the occupant is not in the room. It is relatively easy for a previous user of the room to have a duplicate key made and return to that room at a later time with the thought of perpetrating a burglary. There are other reasons for not wanting a person to be able to unlock the key-in-knob lock when the traveler is not occupying the room, such as when sightseeing or making business visits. In this regard, the renter of the hotel or motel room may very well have valuable equipment therein that must be safeguarded from maids and other hotel personnel when the renter is away.

A number of patents have been granted for various protective devices as far as doorknobs having keyholes therein are concerned. One such patent is U.S. Pat. No. 3,245,240 issued on Apr. 12, 1966 to William E. De Forrest for "Knob Protector". Another such device is disclosed in U.S. Pat. No. 3,636,742 granted on Jan. 25, 1972 to Gerrel B. Raney for "Lock-Out Key Holder". Although it is not known to me whether such prior art devices have been marketed, it is apparent that certain shortcomings are inherently in the alluded to devices which could conceivably account for their nonuse, or for such limited use that the devices have not come to my attention.

SUMMARY OF THE INVENTION

One general object of my invention is to provide an accessory or auxiliary locking device for doorknobs having keyholes therein that will reliably prevent unauthorized persons from opening the door with such a doorknob incorporated therein, my device reliably obstructing the doorknob's keyhole so that the door's usual key cannot be inserted therein.

Another object of the invention is to provide an accessory locking device for preventing access to the keyhole of a doorknob that can be inexpensively manufactured, thereby encouraging its widespread use.

Another object of the invention is to provide a protective device for key-in-knob locks that is compact and lightweight so that it can be readily carried by the traveler so that the traveler can use it repeatedly and regularly while traveling from hotel or motel to hotel or motel.

Yet another object of the invention is to provide an accessory locking device for doorknobs having keyholes therein that is comprised of two units, one of which units encloses the doorknob and the other of which units keeps the enclosing unit on the doorknob so that the usual key for the doorknob cannot be employed to unlock the door. More specifically, an aim of the invention is to provide an enclosure unit that will be fabricated in a size adequate to protect most sizes of doorknobs, yet include a keeper unit that can have various locks associated therewith so that the person has a choice of keeper units. In this regard, it is within the contemplation of the invention to provide a number of different keeper units which can be distributed to various authorized persons so that each person when using the enclosing unit can be sure that his or her own keeper unit will be adaptable to the enclosing unit.

The above versatility can be employed when circumstances so dictate to exclude a normally authorized person from at times entering a room by merely temporarily using a keeper unit having a different lock. For instance, a laboratory area may normally be restricted to a group of authorized workers, but at other times be limited to only a few technicians, or on occasion to but a single worker. A similar condition sometimes exists with apartments and houses, especially those available for rent or sale. Therefore, an aim of my invention is to provide a locking device that can be employed in various ways, depending upon the particular situations.

Still another object of the invention is to provide a protective locking device for keyhole-type doorknobs that will be virtually tamper proof, not being vulnerable to being pried open by someone not having the proper key for the keeper unit. In other words, once the enclosing unit has been applied to the doorknob and the keeper unit engaged therewith, the enclosing unit cannot be broken so as to permit unauthorized access to the keyhole belonging to the doorknob.

Briefly, my invention envisages a pair of generally cup-shaped shells hingedly connected together at adjacent edges so that they can, when swung together, enclose a typical key-in-knob lock belonging to the door of a hotel or motel room (or other room to be protected). The shells are provided with specially configured flanges at the edges opposite the hinged edges so that when the flanges are brought into a confronting relationship with each other, a special keeper unit can be slidably engaged with the convex surface portions of the flanges, the keeper unit including a tubular member having inner concave surfaces generally complementing the convex surface portions of the flanges. Secured, such as by welding, to the tubular keeper member is a cylindrical lock mechanism, the cylindrical lock mechanism having a barrel that is permanently affixed to the tubular member in a piggy-back manner. A hole in the tubular member permits the bolt of the cylindrical locking mechanism to be projected downwardly into notches formed in the edges of the flanges. When the bolt is so projected, the keeper unit cannot be removed from the enclosing unit, yet when the bolt of the auxiliary locking unit is retracted, then the keeper unit can be readily removed by reversely sliding or pulling the keeper unit from the flanges. When this is done, then the enclosing unit can be swung open and removed from the doorknob to provide access to the keyhole contained in such doorknob. An overlapping flange makes it such that one cannot pry apart the enclosing unit when in its protecting or guarding relationship with the doorknob.

BRIEF DESCRIPTION OF THE DRAWINGS

FIG. 4 is a perspective view of the enclosing unit in an open condition without any doorknob being present;

FIG. 5 is a sectional detail taken in the direction of line 5—5 of FIG. 1 for the purpose of showing the manner in which the keeper unit prevents removal of the enclosing unit, and FIG. 6 is a perspective view of a modified keeper unit.

DESCRIPTION OF THE PREFERRED EMBODIMENTS

Figure 1:
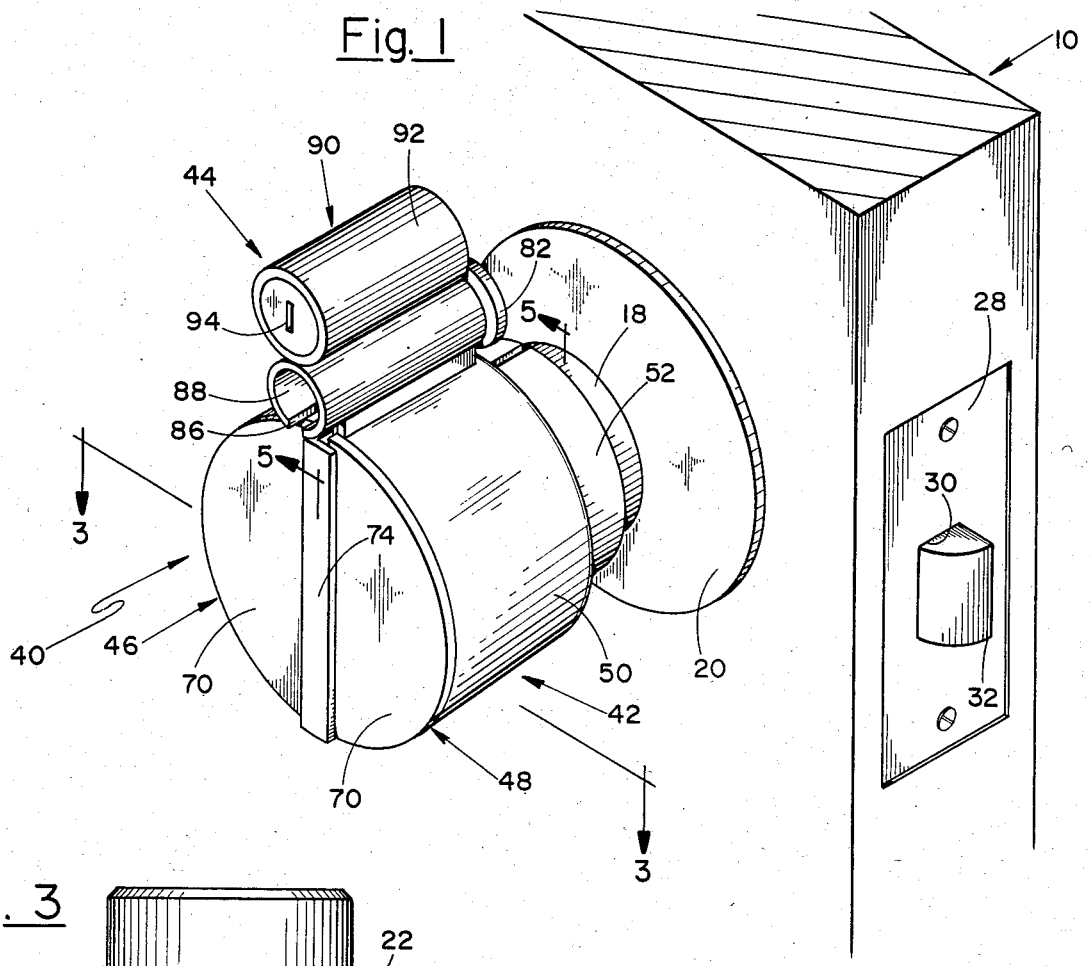
FIG. 1 is a perspective view of an accessory locking device exemplifying my invention, the device being mounted on the doorknob of a fragmentarily depicted door.
Figure 3:
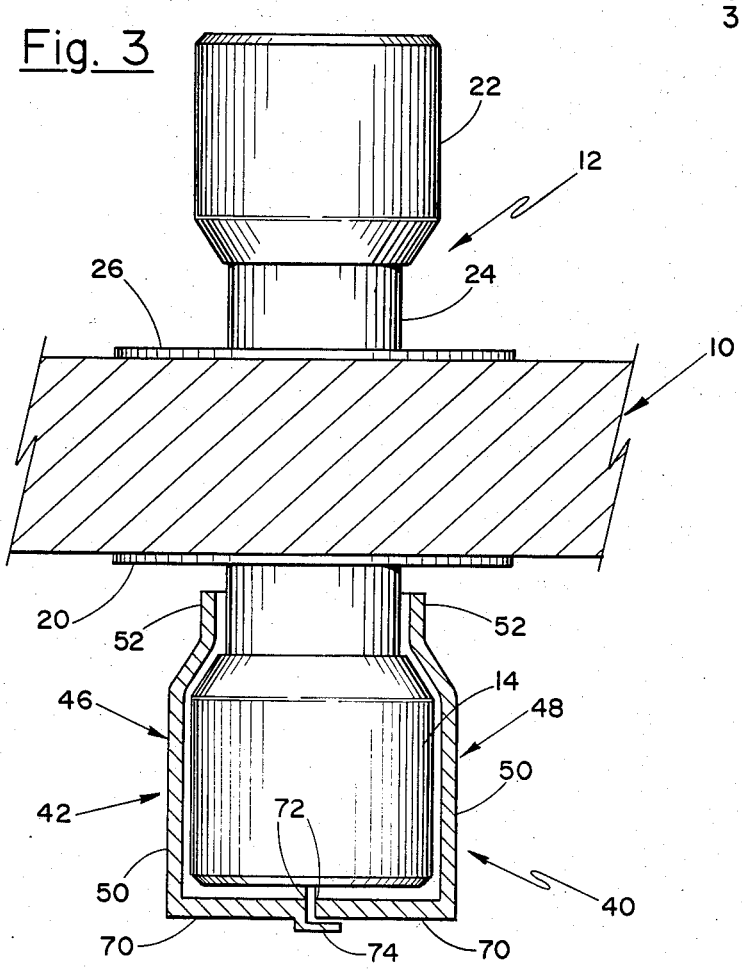
FIG. 3 is a sectional view of my device taken in the direction of line 3—3 of FIG. 1, the view showing the outer doorknob and also the inner doorknob, the latter not being visible in FIGS. 1 and 2.
Figure 2:
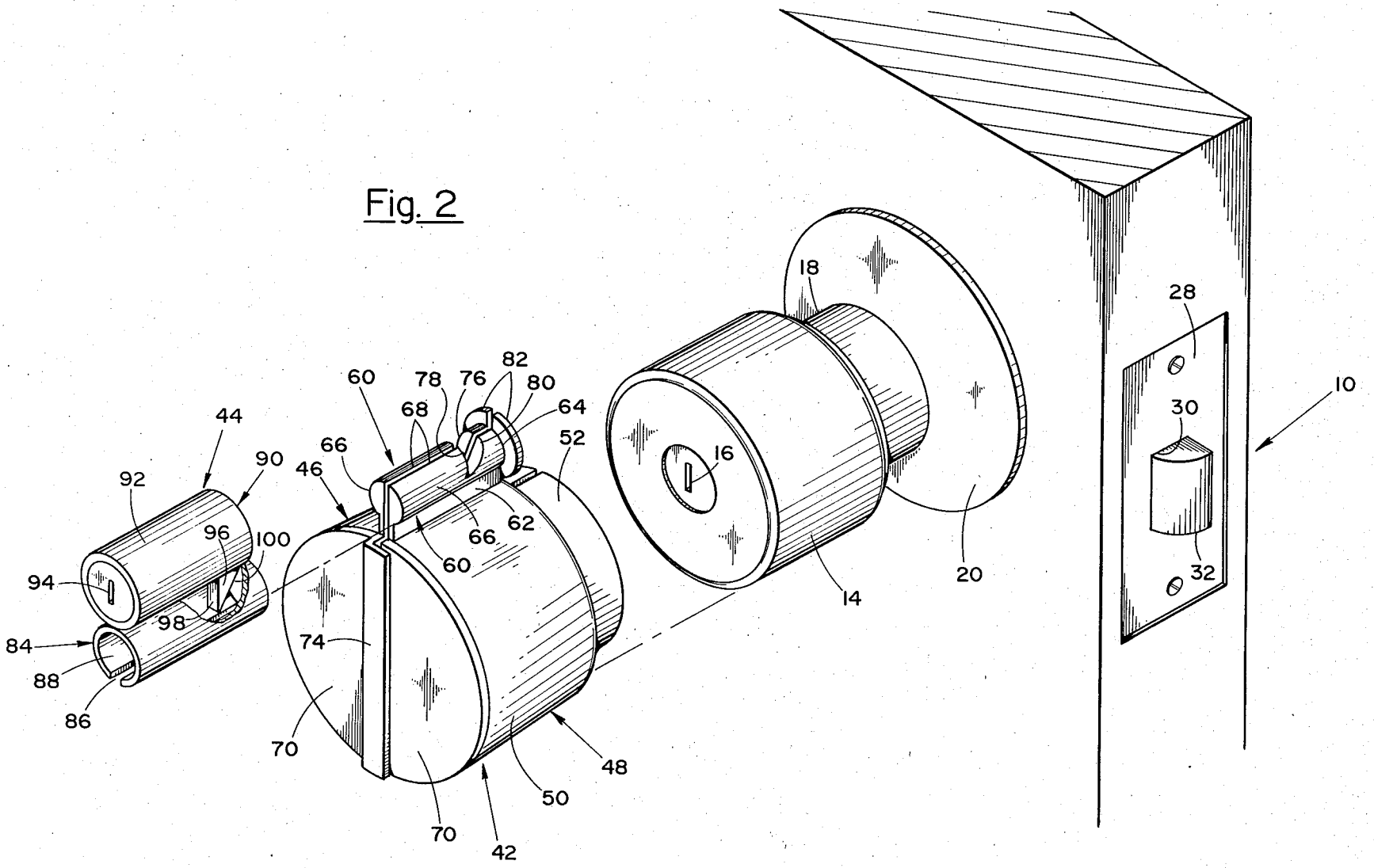
FIG. 2 is an exploded perspective view taken in the same direction as FIG. 1 but illustrating the two units comprising my device in a separated relationship with each other and also separated from the doorknob that is concealed when being protected as it is in FIG. 1.

In order to illustrate the benefits to be derived from a practicing of my invention, a door 10 has been fragmentarily pictured in FIGS. 1-3. It can be considered that the door 10 is a door belonging to a room of a hotel or motel. However, it could be the door of an apartment or house, a laboratory door, or virtually any area requiring securing precautions.

Typically hotel and hospital doors 10 are equipped with a cylindrical lock assembly, such a lock assembly having been generally indicated by the reference numeral 12. More specifically, the lock assembly 12 comprises what will be termed an outside doorknob 14 having a keyhole 16 therein. The doorknob 14 has a neck 18 of reduced diameter which extends into the door 10, doing so through a rose plate or escutcheon 20. Somewhat similarly, the assembly 12 additionally includes an inside doorknob 22 having a neck 24 of reduced diameter that extends through a second rose plate or escutcheon 26. As is conventional, the assembly 12 includes a latch front plate 28 having a rectangular opening 30 through which a bolt head 32 projects.

The accessory locking device illustrating my invention has been denoted generally by the reference numeral 40. The device 40 includes an enclosing unit 42 and a keeper unit 44. The keeper unit 44 is completely separable from the enclosing unit 42 when the two units 42, 44 are not being used.

Describing the enclosing unit 42 it will be observed that this unit 42 includes first and second cup-shaped shells 46 and 48. The shells 46, 48 are virtually mirror images of each other. Thus, it will be perceived from FIGS. 1-3 that each includes a semicylindrical section 50 of a sufficiently large radius so as to accomodate one-half of the knob 14, and a much smaller semicylindrical section 52, the smaller section 52 having a radius sufficient to partially encircle the neck 18 of the doorknob 14 but sufficiently small so as to offer obstructive interference such that the enclosure unit 42 cannot be removed when the two cup-shaped shells 46, 48 are enclosing the doorknob 14.

It will help, it is thought, to point out that the enclosure unit has a hinge at 54 which pivotally connects the two shells 46, 48 together along an axis adjacent their respective edges 56. The other edges 58, which are opposite the hinge 54, are each provided with an outwardly projecting flange 60 having a relatively thin section 62 and a relatively thick section 64, the relatively thick section 64 being outwardly of the relatively thin section 62. More specifically, it will be recognized that the relatively thin section 62 is in the form of a strip integral with the edge 58, whereas the relatively thick section 64 is rounded so as to provide a convexly curved outer surface 66. Each flange 60 has a flat inner surface 68, the two flat inner surfaces 68 confronting each other when the two shells 46, 48 are pivoted or swung together to enclose the doorknob 14 as in FIG. 1 (and also FIG. 2, although the enclosing unit 42 has been removed from the doorknob 14 in this view).

Each shell 46, 48 also includes a semicircular disc or panel 70 which coact with each other to prevent access to the keyhole 16 of the doorknob 14 when the two shells 46, 48 are swung together. Inasmuch as there will be a resulting crack or slit, even though quite narrow, between the vertical edges 72 of the semicircular panels 70 when the shells 46, 48 are in their enclosing relationship, that is, when the flanges 60 are confronting each other, the semicircular panel 70 belonging to the shell 46 is formed with an offset flange 74 extending along its vertical edge 72, the flange 74 overlapping the vertical edge 72 of the semicircular panel 70 on the shell 48 when the two shells 46, 48 are pivoted together to enclose the doorknob 14.

It is important to note that each flange 60 is formed with a notch 76, each notch 76 having a vertical edge 78 and an inclined edge 80. It might be explained at this stage that the two flanges 60 can be fabricated from a split bolt or rod, each flange 60 then having one-half of the bolt or rod integral therewith. It is important that the outer surfaces 66 of the flanges 60 diverge from the strip portion 62, the reason therefor being apparent from the description to be given below for the keeper unit 44. It is also advantageous to have a radially directed flange 82 on the far end of each of the flanges 60, the reason therefor becoming manifest hereinafter.

At this time, the construction of the keeper unit 44 will be described. The unit 44 includes a keeper tube 84 formed with a slot 86 having a width sufficient to accomodate therein the thickness of the two strips 62 (one on each flange 60). By virtue of the tube 84 having concave inner surfaces 88, it will be appreciated that the tube 84 can be slid longitudinally over the two flanges 60, and once so engaged the flanges are held in their confronting relationship so that the shells 46 and 48 cannot be swung apart, that is into an open relationship, such as that pictured in FIG. 4.

The keeper unit 44 further includes a rather small cylindrical lock 90 having a barrel 92 and a keyhole 94. Also, the cylindrical lock 90 has a projectable and retractable bolt 96 provided with a vertical edge 98 and an inclined edge 100, the bolt 96 being projectable and retractable through a hole or aperture 102 provided in the upper portion of the keeper tube 84. It will be understood that the bolt 96, when projected, extends into the notches 76 belonging to the two flanges 60. When so engaged, the vertical edge 78 of each notch 76 provides obstructive interference with the vertical edge 98 of the bolt 96, thereby preventing the keeper tube 94 from being slid or removed from the rounded sections 64 of the flanges 60. However, the keeper tube 84 is easily removed from the flanges 60 when the bolt 96 is retracted upwardly into the barrel 92 of the cylindrical lock 90.

It is planned that the shells 46, 48 of the enclosing unit 42, as well as the flanges 60 projecting therefrom, be made of steel. Likewise, the keeper tube 84 of the unit 44 is also intended to be of steel. The keeper tube 84 is easily welded to the barrel 92 of the cylindrical lock 90. When so secured, the two members 84 and 90 are fixedly connected together so that the keeper unit 44, as its name signifies, is truly a unit.

The use of my accessory locking device 40 should be obvious from the description that has been given. Nonetheless, in order to assure that the full benefits of my invention are appreciated, a brief description of how the device 40 is employed will now be given. It should be borne in mind that the doorknob 14, which is provided with the keyhole 16, belongs to a door that should be held shut, such as when the occupant of the room is away. To do this, the person using the device 40 carries both units 42, 44 with him. When the doorknob 14 is to be protected so that access to the keyhole 16 is prevented, the user simply swings the two shells 46, 48 upwardly from a wide open relation so that the flanges 60 thereon confront each other, or substantially confront each other in that they need not actually engage. In other words, the flat inner surfaces 68 need not physically touch when the two shells 46, 48 are in their enclosing or encompassing relationship with the doorknob 14.

Once having swung the two shells 46, 48 upwardly into the position in which they appear in FIG. 1 (and also in FIG. 2), the keeper unit 44 by reason of the tube 84 can be longitudinally advanced so that the tube 84 telescopically embraces the rounded sections 64 of the flanges 60. Once so engaged, then the user takes his or her key that fits the auxiliary cylindrical lock 90, turning the key so as to project the bolt 96 downwardly into obstructive engagement with the two notches 76 formed in the flanges 60. It might be pointed out that the longitudinal advancement or sliding movement of the keeper unit 44 causes the right end of the keeper tube 84 to abut the radial flanges 82 on the right end of the two flanges 60.

It is important to recognize that the enclosing unit 42 and the keeper unit 44 comprising my locking device 40 are separate and distinct components. This feature enables the enclosing unit 42 to be mass produced in an identical form during manufacture. Virtually the same thing can be said for the keeper unit 44. However, it should be recognized that various keeper units 44 should be fabricated with different cylindrical locks 90 attached thereto so that different keys would be used. It will be appreciated that the cylindrical lock 90 is preferably of the pick-proof type. Should a keeper unit 44 be lost or misplaced, the owner of my device 10 would not have to repurchase the enclosing unit 42, only buying another keeper unit 44. The use of a separate keeper unit 44 also can prove advantageous where from time to time various persons are to have access to a room provided with a key-in-knob lock, it only being necessary for each person to have a particular keeper unit 44 that would enable that person to make use of whatever enclosing unit 42 was at that moment available. All that the person would have to do is to use the available enclosing unit 42 in combination with his particular keeper unit 44, his particular keeper unit 44 having a lock with a keyhole that accepts only his personal key. For instance, in research areas there might very well be periods during which a group of authorized persons should be allowed to enter a room, yet at times the room should be restricted to only one or two laboratory people. My invention permits a more restricted entry to be readily realized. Thus, there is a distinct advantage in having the keeper unit 44 separate from the enclosing unit 42.

When the shells 46, 48 are closed or swung together, as in FIG. 1, it should be recognized that the flange 74 that overlaps or overhangs the vertical edge 72 of the semicircular disc or panel 70 at the right thwarts any attempts to pry the two semicircular discs or panels 70 apart. By having the overlying flange 74, manufacturing tolerances can be increased, for it is not necessary that the vertical edges 72 of the two semicircular discs or panels 70 actually touch each other. Likewise, it is not in any way essential that the two flat surfaces 68 belonging to the flanges 60 touch each other. It is necessary, however, that the keeper tube 84 be of a size so as to be longitudinally slidable over the rounded sections 64 on the two flanges 60 when brought together; however, there need not be a close fit. All that is necessary is that the bolt 96 belonging to the auxiliary lock 90 extend downwardly into the notches 76 to prevent reverse sliding of the keeper unit 44 until it is desired that the keeper 44 be removed from the enclosing unit 42.

While it is highly desirable that the bulging or rounded sections 64 of the flanges 60 be rugged, it is possible to reduce manufacturing costs by making the two shells 46, 48 of sheet metal, as can be understood from FIG. 6. For the most part, the construction of the device 140 illustrated in FIG. 6 is identical to the construction of the device 40 shown in FIGS. 1–5. However, if the shells 46, 48 are to be fabricated from sheet metal, it is possible to stamp the sheet metal so as to form the flanges 160 with the convexly curved outer surfaces 166 of FIG. 6. While not as rugged and break resistant as the more solid flanges 60 of FIGS. 1–5, the curvature imparted to the flanges 160 just mentioned will usually suffice to prevent any opening or separation of the shells 146, 148.

In practice, the inner surfaces of the shells 46, 48 and 146, 148 will be suitably lined with a layer of felt or coated with a suitable plastic in order to prevent scratching and marring of the various doorknobs 14 to which my locking device 40 or 140 is applied. It would serve no useful purpose, however, to illustrate such a protective layer or coating.

I claim:

1. An accessory locking device for a doorknob having a keyhole therein comprising first and second mateable shells for enclosing the doorknob and its keyhole, said shells having edges confronting each other when said shells are mated, first flange means extending longitudinally along a portion of the edge of said first shell and projecting outwardly therefrom, second flange means extending longitudinally along a portion of the edge of said second shell and projecting outwardly therefrom, said first flange means having an exposed outer surface diverging in a direction away from said second flange means and away from said first shell, keeper means for slidably engaging both of the flange means on said shells, at least one of said flange means having an outwardly facing notch therein, and said keeper means having a bolt projectable inwardly into said notch to maintain said shells in their said mated relationship and thus prevent access to said keyhole.

2. An accessory locking device in accordance with claim 1 in which each of said shells includes a semicylindrical section of a size sufficient to accommodate therein said doorknob when said shells are in their mated relationship and each shell having a semicylindrical section of lesser size so as to accommodate therein the neck of the doorknob when said shells are mated.

3. An accessory locking device in accordance with claim 2 in which each of said shells includes a semicircular panel preventing access to said keyhole when said shells are mated.

4. An accessory locking device for a doorknob having a keyhole therein comprising first and second mateable shells for enclosing the doorknob and its keyhole, flange means on each of said shells and each of said flange means being formed with a convexly curved outer surface, said shells confronting each other when said shells are mated, and keeper means for slidably engaging the convexly curved outer surfaces on said flange means to maintain said shells in their said mated relationship and thus prevent access to said keyhole, said keeper means being formed with a concavely curved inner surface for each of said convexly curved outer surfaces and in which said keeper means has a slot of sufficient width to accommodate said flange means therein and thus retain said keeper means in engagement with said shells.

5. An accessory locking device in accordance with claim 4 in which at least one of said flange means includes a notch therein and said keeper means includes a bolt projectable into said notch.

6. An accessory locking device in accordance with claim 5 in which each of said flange means includes a notch, the notches being in registry with each other when said flange means are in a substantially confronting relationship.

7. An accessory locking device in accordance with claim 6 including means hingedly connecting said shells together, said hinge means being located substantially opposite said flange means.

8. An accessory locking device for a doorknob having a keyhole therein comprising first and second mateable shells for enclosing the doorknob and its keyhole, flange means on each of said shells, each of said flange means being formed with a convexly curved outer surface, said shells confronting each other when said shells are mated, and keeper means for slidably engaging the flange means on said shells to maintain said shells in their said mated relationship and thus prevent access to said keyhole, said keeper means being formed with a concavely curved inner surface for each of said convexly curved outer surfaces, and said keeper means additionally including a slotted tube for telescopically receiving therein said convexly curved outer surfaces.

9. An accessory locking device in accordance with claim 8 including an auxiliary cylindrical lock having a barrel, said barrel being secured to said tubular member.

10. An accessory locking device in accordance with claim 9 in which said tubular member has a hole therein through which the bolt of said cylindrical lock can be projected into obstructive interference with at least one of said flange means.

11. An accessory locking device in accordance with claim 10 in which said one flange means has a notch into which said bolt is projected to produce said obstructive interference.

12. An accessory locking device for a doorknob having a keyhole therein comprising a pair of cup-shaped shells for enclosing the doorknob, said shells having first and second adjacent edges, hinge means connecting said first and second adjacent edges together, said shells having third and fourth edges that are swung into adjacency with each other when said shells enclose the doorknob having said keyhole therein, a flange on each of said third and fourth edges, said flanges projecting radially from said shells so as to substantially confront each other when said third and fourth edges are in an adjacent relationship, said flanges having rounded portions, and keeper means including a tubular member having a slot therein of a width less than the combined width of said rounded portions, an auxiliary cylindrical lock having a barrel secured to said tubular member, said tubular member having a hole therein so that the bolt of said auxiliary lock can be projected through said hole, said flanges having notches therein which are engaged by said bolt when projected so as to prevent longitudinal withdrawal of said tubular means relative to said flanges when said bolt is engaged in said notches.

13. An accessory locking device for a doorknob having a keyhole therein comprising first and second mateable shells for enclosing the doorknob and its keyhole, each of said shells including a semicylindrical section of a size sufficient to accommodate therein said doorknob when said shells are in their mated relationship and each shell having a semicylindrical section of lesser size so as to accommodate therein the neck of the doorknob when said shells are mated and said shells additionally including a semicircular panel preventing access to said keyhole when said shells are mated, one of said semicircular panels including an offset flange for overlying a marginal portion of the other semicircular panel when said shells are mated, flange means on each of said shells, said shells confronting each other when said shells are mated, and keeper means for slidably engaging the flange means on said shells to maintain said shells in their said mated relationship and thus prevent access to said keyhole.

14. An accessory locking device for a doorknob having a keyhole therein comprising first and second mateable shells for enclosing the doorknob and its keyhole, said shells having edges confronting each other when said shells are mated, first flange means extending along a portion of the edge of said first shell and projecting outwardly therefrom, second flange means extending along a portion of the edge of said second shell and projecting outwardly therefrom, said first and second flange means having exposed outer surfaces diverging in directions away from each other and both of said outer surfaces being convexly curved, keeper means for slidably engaging both of the flange means on said shells, said keeper means being formed with a concavely curved inner surface for each of said convexly curved outer surfaces and at least one of said flange means having a notch therein, and said keeper means having a bolt projectable into said notch to maintain said shells in their said mated relationship and thus prevent access to said keyhole.

* * * * *